United States Patent [19]

Várkonyi et al.

[11] Patent Number: 4,820,080

[45] Date of Patent: Apr. 11, 1989

[54] PROCESS FOR THE CONSTRUCTION OF A DRAIN SYSTEM

[75] Inventors: László Várkonyi; Gyula Váci, both of Miskolc, U.S.S.R.; Csaba Asszonyi, Budapest, Hungary

[73] Assignee: Comporgan System House, Hungary

[21] Appl. No.: 24,775

[22] Filed: Mar. 11, 1987

[30] Foreign Application Priority Data

Mar. 21, 1986 [HU] Hungary ..... 1195/86

[51] Int. Cl.[4] ..... E02B 11/00

[52] U.S. Cl. ..... 405/45; 405/36; 405/43

[58] Field of Search ..... 405/45, 48, 43, 51, 405/50, 47, 46, 36

[56] References Cited

U.S. PATENT DOCUMENTS

| | | | |
|---|---|---|---|
| 599,719 | 3/1898 | Manning | 405/43 X |
| 968,226 | 8/1910 | Zilley | 405/45 |
| 1,866,826 | 7/1932 | Strothmann | 405/45 |
| 3,396,541 | 8/1968 | Lamberton | 405/50 |
| 3,403,519 | 10/1968 | Balko | 405/45 |
| 4,019,326 | 4/1977 | Herveling et al. | 405/45 |
| 4,403,890 | 9/1983 | Miyanagi et al. | 405/184 |

FOREIGN PATENT DOCUMENTS

| | | | |
|---|---|---|---|
| 2137417 | 2/1923 | Fed. Rep. of Germany | 405/50 |
| 794744 | 12/1935 | France | 405/45 |
| 0059210 | 5/1980 | Japan | 405/50 |
| 0203114 | 11/1984 | Japan | 405/43 |
| 2028405 | 3/1980 | United Kingdom | 405/216 |

*Primary Examiner*—Dennis L. Taylor

*Attorney, Agent, or Firm*—Handal & Morofsky

[57] ABSTRACT

A process for the construction of a drain system, wherein a catchment body and at least one interconnected suction body are laid into the soil to be dewatered. Starting from a working pit (3) or bank, a nearly horizontal hole (9) is drilled for the catchment body (B), furthermore a hole (8) or shaft (18) preferably reaching the vicinity of an impermeable clay layer (2) is made from the ground surface for the suction body (A) transversely to and in communication with the hole (9) of the catchment body (B).

19 Claims, 5 Drawing Sheets

PROCESS FOR THE CONSTRUCTION OF A DRAIN SYSTEM

FIELD AND BACKGROUND OF THE INVENTION

The invention relates to a process for the construction of drain system.

The purpose of the drain system, and drying rib or other structure is to protect earth banks or engineering structures against the detrimental effect of the flowing or seeping groundwater. The process according to the invention is applicable for dewatering the slipping, wet, cohesionless or cohesive soils and layers exposed to the risk of land-slide.

Drain systems, drying ribs or similar structures are built to arrest soil movements, or to anticipate expectable soil movements. These are made for two reasons, partly the drain system removes the undesirable groundwater, which will influence favourably the slope stability, and partly the friction arising on the surface of the ribs prevents the soil movement. Besides protection of the bank, insulated or poorly insulated structures are frequently protected against seeping groundwaters with the construction of drain systems.

At the same time the drain system is built by excavating the soil from the timbered pit manually, or mechanically, then concrete bed is laid at the bottom of the trench, on which a permeable medium or drain pipe is arranged. A highly permeable suction body is built above it, sealed with clay plug stamped on the ground surface. This clay plug protects the suction body against the clogging effect of the surface waters. For this purpose, occasionally, a covered surface catchwater drain is built above the drain system.

According to experiences, the above process is very expensive, demanding much manual labor and interference with the environment. For these reasons this process for cases involving 6–8 m depth is more and more avoided.

Such process for the construction of a drain system is known from Hungarian patent specification No. 178 870, where effective deep drain systems are built with dry cutting in stable, e.g. clayey soils. This process utilizes the property present in the more cohesive soils, that the walls of a 7–8 m deep pit remain stable for a short time, until the drain pipe and suction body are built in. Prior to building the drain system, such wide working area is required as to be suitable for the safe traffic of the bulldozers and transport vehicles. The drain pipes are lowered manually and with bulldozers into the trench excavated with a trench-dredger, and laid into a dry concrete bed. Then the drain pipe is covered with crushing as suction body, followed with sandy gravel covered with geotextile.

According to experience, the use of this process at a depth of 8 m is uncertain, caving-in of the pits is frequent, requiring complicated and costly restoration. Further shortcoming of the process is, that it cannot be used in depth beyond 10 m, and in cohesionless, e.g. sandy soils, or when such layers alternate.

OBJECTS AND SUMMARY OF THE INVENTION

The invention is aimed at elimination of the above shortcomings, and to realize a process for the construction of a drain system, which satisfies the existing hydrogeological and soil mechanical requirements in optional depth and under any soil or layer conditions.

In order to solve the problem, starting out of the process for the construction of a drain system, a catchment body and at least one interconnected suction body are laid into the soil to be dewatered. This was further developed according to the invention, by preparing a nearly horizontal hole for the catchment body, starting from a pit or bank, furthermore a hole or shaft is prepared for the suction body from the ground surface, transversely to and in communication with the hold of the catchment body, which preferably extends to the impermeable clay layer.

Two or several parallel and vertical holes or shafts can be made from the ground surface, for the suction bodies, forming together with the catchment body a comb-shaped drain system.

According to a further characteristic feature of the invention, the catchment body is formed preferably with a drain pipe arranged in the nearly horizontal hole, which in a given case is assembled from pipe sections connected to each other with sleeve joints, and covered preferably with geotextile filter.

According to another feature of constructing the catchment body, first a casing lined with a geotextile roll is placed into the nearly horizontal hole, then a granular charge is pressed into the geotextile roll and finally the casing is removed.

The suction bodies can be formed preferably with perforated pipes placed into the holes. According to the invention, the suction bodies can be formed with granular material filled into geotextile bag arranged in the hole or shaft.

According to a further characteristic feature of the invention, first the vertical holes or shafts of the suction bodies are prepared along a designated traceline, then a plug made of a geotextile bag lines preferably with a synthetic fiber quilt is placed into the vicinity connected with the catchment body, followed by placing granular charges, filled into geotextile bags, on these plugs. Then the nearly horizontal hole of the catchment body is drilled, so that it passes through the plugs of the suction bodies. Finally, the catchment body is placed into the nearly horizontal hole.

It is advisable to drill the diameter of the holes for the suction bodies to be between 30 and 60 cm. If the suction bodies are formed in shafts, it is advisable to prepare their rectangular cross section to be 1.5–1.6 m long and 0.4–0.7 m wide, with a cutting machine.

The suction bodies are laid at a suitable distance from each other, depending on the permeability of the soil and extent of the internal water drainage.

BRIEF DESCRIPTION OF THE DRAWINGS

The invention is described in detail with reference to the drawings illustrating the method of implementation by way of some examples, in which.

DESCRIPTION OF THE PREFERRED METHODS

Figure 1:
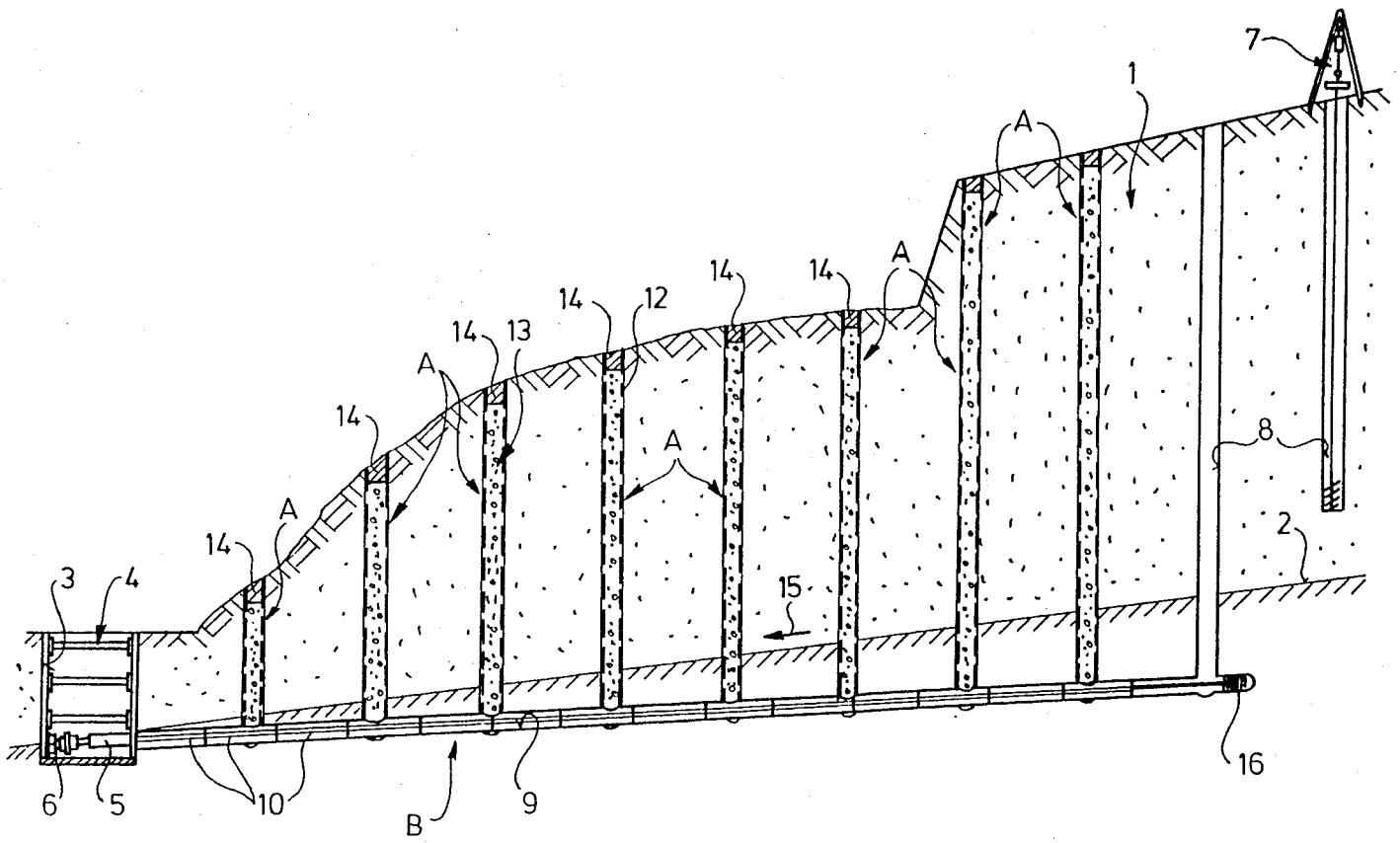
FIG. 1: Schematic vertical section of the deep drain system produced with the process according to a invention, by way of the first example.

Similar details are marked with the same reference numbers in the drawing.

FIG. 1 shows a mass of earth 1 slipped on a clay layer 2 underneath. Deep drain system was built with the process according to the invention for lowering the level of groundwater.

First a pit 3 was prepared, provided with conventional reinforcing timbering 4. A conventional drilling machine 5 and a pipefeeding machine 6 were placed into the pit 3.

In the present case 30–60 cm diameter holes reaching the clay layer 2—were drilled parallel with and at a distance from each other, along the previously designated trace-line, with a vertical drill 7 for suction bodies A (starting from the working pit 3).

At the same time, or subsequently a nearly horizontal hole 9 is drilled with the drilling machine 5 for receiving a catchment body B, which passes through the lower part of the holes 8.

Next, synthetic pipe sections 10 perforated with 5 mm holes, covered with geotextile (known as "TERFIL" filter cloth in the trade) are fed with pipe-feeding machine 6 into the hole 9, which are interconnected with conventional method, e.g., sleeve joint. The diameter of the hole 9 was selected to be greater by 5–10 cm, than that of the pipe sections 10 shown. The series of pipe sections 10 form a drain pipe 11.

Prefabricated geotextile bags 12 are placed into the vertical holes 8 to be filled with a granular charge 13, e.g. crushing, or gravel.

In the present case, the drain system is built in such a way, that after finishing each suction body A, the hole 9 is drilled further, and further pipe section 10 is pushed forward. Upon completion of the whole drain system, the upper end of the suction bodies A is sealed with a clay plug 14. The groundwater from the vicinity above the clay layer 2 flows vertically down through the suction bodies A, then through the perforations of the pipe sections 10 into the catchment body B, i.e. here, into the drain pipe 11. On the other hand the low gradient of the drain pipe 11 conducts the groundwater into the water-receiving canal or trench (not shown in the drawing). The depth of the vertical hole 8 can be 20–30 m, depending on the existing soil conditions, and it may be drilled with or without casing.

The flow direction of the groundwater above the clay layer 2 is marked with an arrow 15, and a bit of the drilling machine 5 is identified with reference number 16 in FIG. 1.

Figures 2, 3:
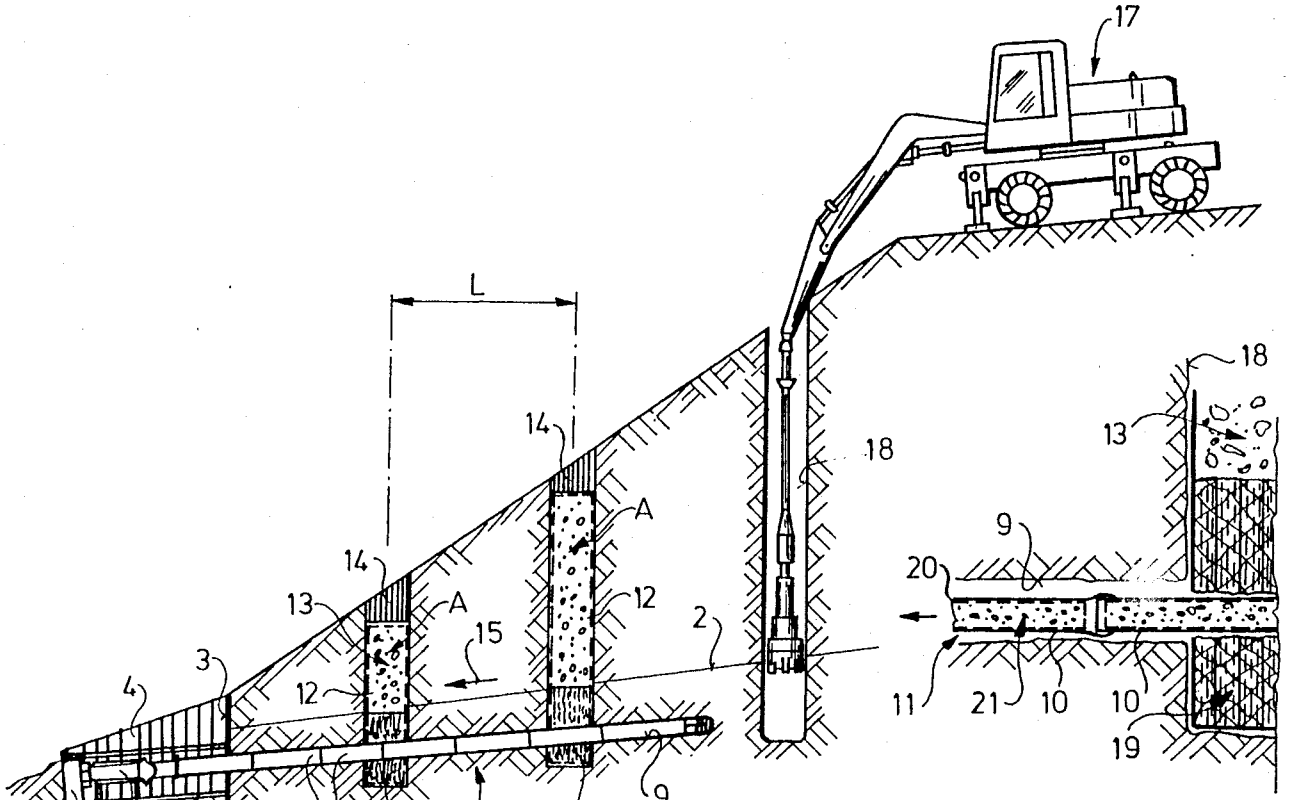
FIG. 2: Vertical section of the implementation method of the process according to the invention by way of a second example.
FIG. 3: Detail of FIG. 2, drawn to a larger scale.

FIG. 2 illustrates a further version of the solution shown in FIG. 1. Here shafts 18 are made with cutting machines 17 for receiving the suction bodies A. The shafts 18 are rectangular with 1.5–1.6 m length and 0.4–0.7 m width. The shafts 18 according to the invention extend below the impermeable clay layer 2 and are in communication with the nearly horizontal hole 9 of the catchment body B.

In the present case, a plug 19 made of geotextile bag filled with synthetic fibre quilt is placed into the shafts 18 at a depth of about 1 m. Above this is the suction body A, namely the granular charge 13 filled into geotextile bag 12. This is sealed similarly by a clay plug 14 on the top.

The purpose of the plug 19 is to enable drilling through the nearly horizontal hole 9, since the subsequent drilling of the gravel or crushing would be problematic.

The nearly horizontal hole 9 of the catchment body B is essentially the same as shown in FIG. 1, drilled with the drilling machine 5 from the pit 3. Here too, the pit 3 is provided with timbering 4, and the drilling machine 6 and the pipe-feeding machine 6 are arranged in the same place.

FIG. 3 clearly shows that the drain pipe 11, the diameter of which is smaller by 5–10 cm is fed into the nearly horizontal hole 9, which consists of the pipe sections 10 connected with sleeve joint. Furthermore, granular charge 21 filled into geotextile bag 20 is arranged in the interior of the pipe sections 10. In given case, naturally the pipe sections 10 can be pulled out even afterwards, because the function of the catchment body B can be accomplished with the charges 21 in the textile bag 20.

The shafts 18 were laid out according to the requirement of draining the groundwater, in the present case the distance L was selected to be between 5 and 10 m.

In the course of the experiments, the nearly horizontal hole 9 of the catchment body B was made with 200–300 mm diameter sleeve pipe. The outside diameter of the drain pipe 11 was selected between 100–150 mm.

Following the withdrawal of the sleeve pipe, the wall of hole 9 in the soil became loose, and the intensive waterflow from the suction bodies A pases through the perforations of the drain pipe 11 into the drain pipe, and thereafter into the catch drain, or catchwater drain (not shown). The textile bag 20 in the drain pipes 11 and the charges 21 in the bags 20 ensure the approximately optimal leakage current.

Figure 4:
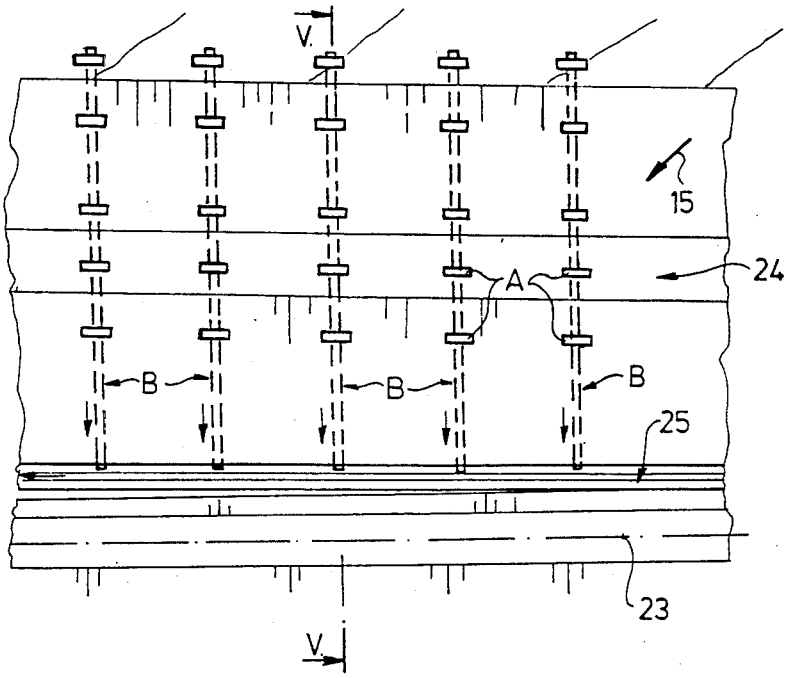
FIG. 4: Top view of the implementation method of the process according to the invention by way of a third example.
Figure 5:
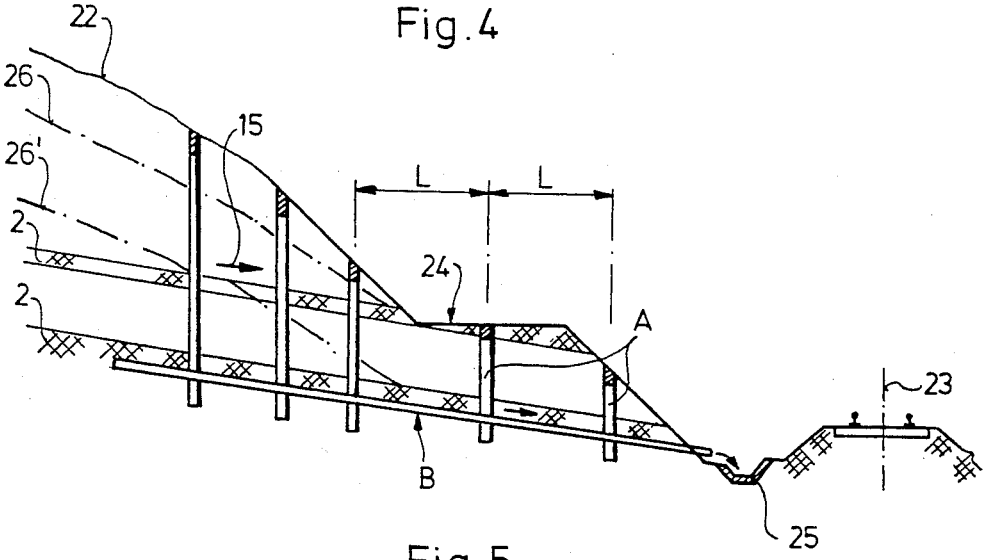
FIG. 5: Section V—V shown in FIG. 4, FIG. 6: Top view of the implementation method of the process according to the invention by way of a fourth example.

In FIG. 4 and 5 a bank along railway track was dewatered with the process according to the invention.

A 5–15 m deep recess 24 was made for a railway track 23 in a hill-side 22. For drainage of the surface waters a covered trench 25 is used along the railway track 23. The catchment area around the recess 24 is fairly large (approximately 15 hectare). The hillside is formed by very thick, loose sandy soil over a clay layer 2. The surface of the clay layer 2 slopes at an angle of 10°–15° towards the recess 24. Further sandy layer is underneath surrounded with another clay layer 2 from below.

The groundwater rises considerably in the highly porous sandy layers above the parallel and sloping clay layers 2, especially after melting of the snow. In this case, the free pores of the sand layer are saturated with water and the cohesion of the soil particles is reduced. Consequently the bank in the flow direction of the groundwater (arrow 15), slips towards the railway track 23. The water saturated sand layer runs off, and ruins the structure of the railway 23 and the trench 25.

In order to protect the railway track 23 and safety of the traffic, stabilization of the hill side was solved with the process according to the invention, i.e. by lowering the groundwater level. The original level of the groundwater is marked with the reference number 26, and the lowered groundwater level—after the construction of the drain system—with 26' in FIG. 5.

FIG. 4 clearly shows that several drain systems were built perpendicularly to the traceline of the railway track 23 and parallel with each other, forming a drain scheme according to the invention. The catchment body B of all the five drain systems lead into th trench 25. The suction bodies A and catchment bodies B were formed as shown in FIG. 2 and 3. The distance L between the suction bodies A was selected to be 5 m in this case.

According to experience, the comb-shaped drain system efficiently reduced the groundwater level in the critical periods. Consequently the soil layers were sufficiently dried, the cohesion between the soil particles was intensified, and the risk of land-slide was eliminated.

Figure 6:
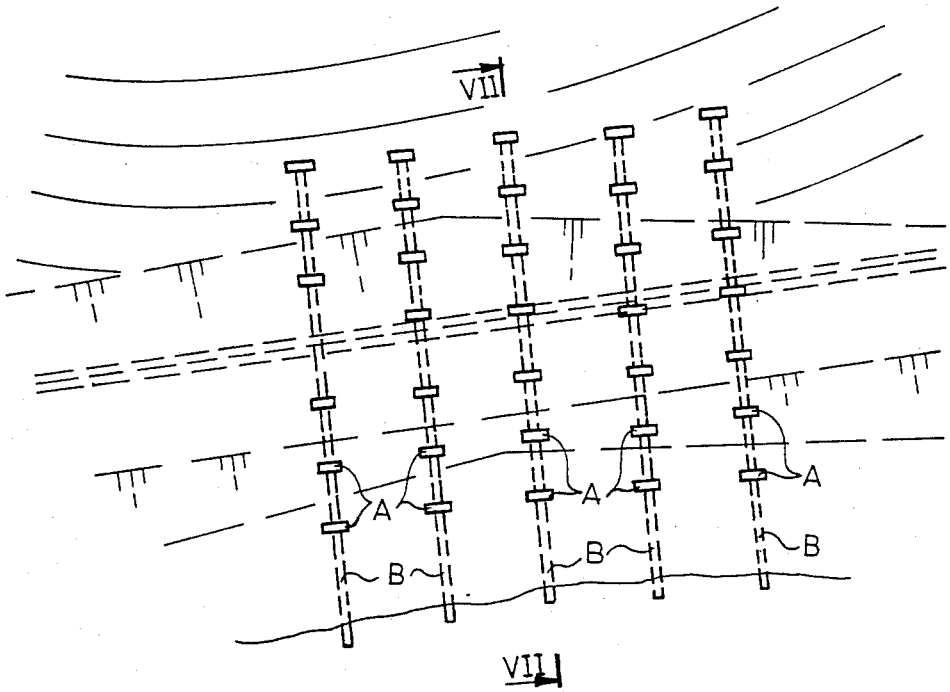

In the example shown in FIG. 6 and 7, the soil layers below a main traffic road to be constructed on the hill-side were dewatered and stabilized.

Figure 7:
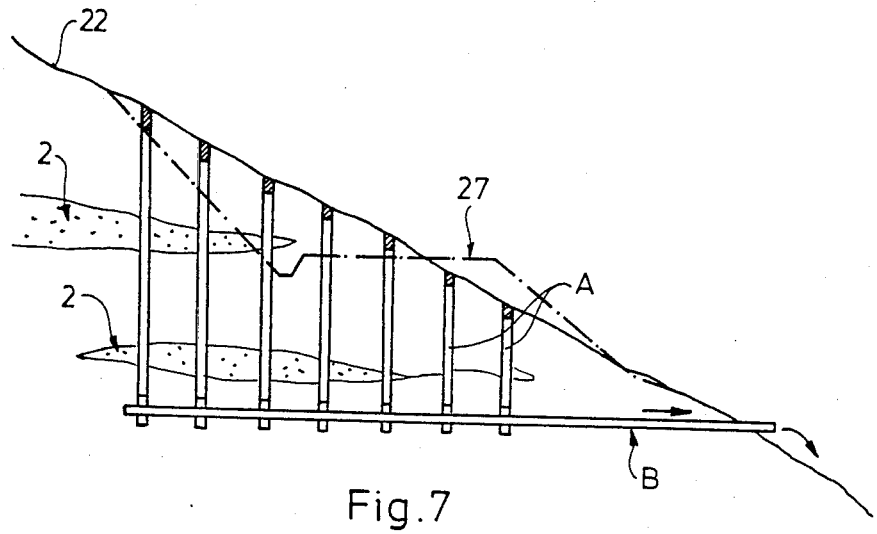
FIG. 7: Section along VII—VII shown in FIG. 6, FIG. 8: Fifth example of the implementation of the process according to the invention.

A traceline of a public road 27 to be built marked with dash-dot line in FIG. 7, is passing along a hill-side 22 inclined to land-slide. For this reason the hill-side 22 had to be stabilized before the road construction.

The hill-side is built mainly of clay layers 2, with more or less thick water-storing sand layers. This stored water softened the surface of the clay layers 2, entailing the risk of slip of the hill-side 22. Therefore it was necessary to collect and drain the water of these layers.

Thus a comb-shaped deep drain system similar to those shown in FIG. 4 and 5 was built in the hill-side 22 with the process according to the invention. Upon completion of the deep drain systems according to the invention, the soil layers were dried, because the detrimental confined groundwaters were collected. This way the soil was sufficiently stabilized within a short time and construction of the public road was commenced under safe conditions.

Figure 8:
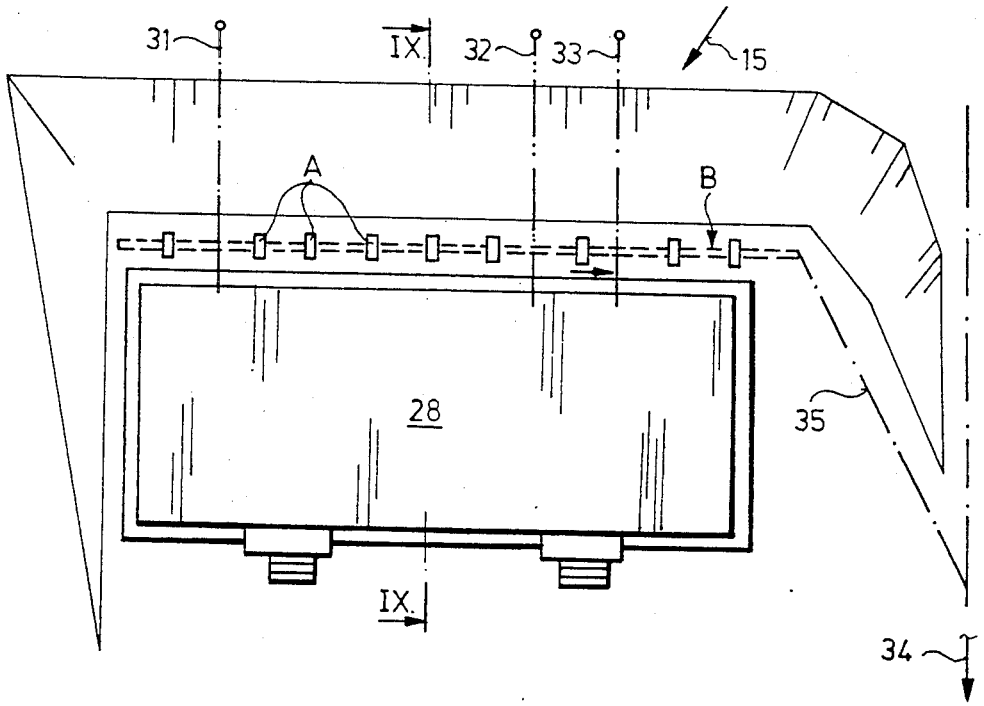
Figure 9:
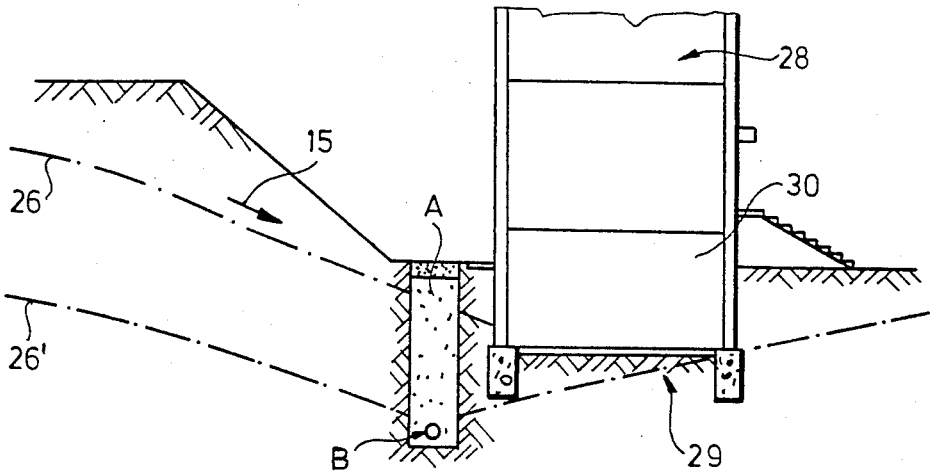
FIG. 9: Section along IX—IX shown in FIG. 8.

Finally FIG. 8 and 9 illustrates an example, where the soil- and cellar-level below a multi-level building is an area provided with public utilities were subsequently dewatered with the process according to the invention.

In the illustrated case a foundation level 29 and a cellar level 30 of a building 28 were built in clayey soil. However sand settled into the clay in some places, and a large amount of water was flowing in those sand layers in the direction of arrow 15 towards the building 28. On account of the deficient insulation of the foundation level 29 and the cellar level 30, the groundwater penetrated the lower level of the building 28, where it accumulated, and deterioration of the bulding's condition became inevitable.

The external pressure of the groundwater in this case, did not allow the subsequent internal insulation, protection against the water. And the external protection was prevented by the public utilities system of the building. Thus comb-shaped deep drain system according to the invention was used for collection and drainage of the groundwater outside the building.

First the location of the public utilities had to be found along the endangered long side of the building 28. FIG. 8 shows a pressure pipe 31, a canal 32, a cable 33 and a precipitation water gang 34.

In possession of the above data, suction bodies A were prepared along the designated traceline at a suitable distance from the foundation body of the building 28 and public utilities, so the lower end of the suction bodies A reached below the public utilities. Next catchment bodies B were built as shown in FIG. 1–5, the outlet of which was connected through an intermediate trough 35 with the precipitation water gang 34.

Upon completion of the construction, according to the experiences, the groundwater level 26 was lowered to the value marked with 26'. Consequently the problems of the building 28 in connection with the groundwater were eliminated.

An important advantage of the process according to the invention is, that under natural conditions, the required working area is relatively small, it needs only minimal surface intervention, i.e. it is an environment protective solution; it requires less amount of material, than the known solutions, and allows the economical and fast construction of the efficient drain system under any soil conditions and in optional depth. An additional advantage is that construction of the drain system is possible even in case of slipped earth banks and steep levels, at a relatively low cost.

The invention naturally is not restricted to the described examples. Several other implementation methods and combinations of the described solutions are conceivable within the protective scope of the claims.

We claim:

1. Process for the construction of a drain system, wherein a catchment body and at least one interconnected suction body are laid into the soil to be dewatered, wherein, from a working pit or bank, a nearly horizontal hole is drilled for the catchment body, and a hole or shaft—preferably reaching the vicinity of an impermeable clay layer—is made from the ground surface for a filled suction body, said hole or shaft directed transversely to and so be in communication with the hole of the catchment body.

2. Process in claim 1, wherein two or several, parallel and preferably vertical holes or shafts are made from the ground surface for two or several suction bodies, which together with the catchment body form a comb-shaped drain system.

3. Process as claimed in claim 1, wherein the catchment body is formed with a drain pipe placed into the nearly horizontal hole, where the drain pipe is assembled with several pipe sections joined with sleeve joint.

4. Process as claimed in claim 3, wherein the drain pipe is covered with geotextile filter.

5. Process as claimed in claim 1 wherein, a casing is driven into the hole drilled when the catchment body is prepared, into which a geotextile roll is arranged, then granular charge is pressed into the geotextile roll, and finally the casing is removed.

6. Process as claimed in claim 2, wherein the suction bodies include perforated pipes placed into the holes.

7. Process as claimed in claim 2, wherein, the suction bodies are formed by placing at least one geotextile bag filled with granular charge into the holes or shafts.

8. Process as claimed in claim 2, wherein, first the holes or shafts of the suction bodies are made, then a plug prefabricated from geotextile bag lined preferably with synthetic fibre quilt is placed into the lower part of the holes or shafts in the vicinity of the intended connection with the catchment body, then the granular charge filled into the geotextile bag is placed in the holes or shafts on the plug, furthermore the nearly horizontal hole of the catchment body is drilled, which passes through the plugs of the suction bodies, and finally the catchment body is built into the hole.

9. Process as claimed in claim 1, wherein, the hole of the suction body has a diameter between 30 and 60 cm.

10. Process as claimed in claim 1, wherein, the shaft of suction body has a rectangular cross-section, the length of which is betwen 1.5–1.6 m, and the width between 0.5 and 0.7 m.

11. Process as claimed in claim 2, wherein, the suction bodies are laid at a distance (L) from each other, depending on the permeability of the soil and extent of the proposed drainage.

12. A process for the construction of a comb-shaped drainage system wherein two or more parallel and substantially vertical holes or shafts are made down into ground to be drained, whereupon a plug comprising a geotextile bag lined with synthetic fiber quilt is placed into each hole or shaft after which at least one granular charge filled geotextile bag is placed into each hole or shaft on top of said plug forming a suction body in each hole or shaft, whereupon a nearly horizontal bore is drilled from a working pit or bank, passing through said plugs forming bases of the suction bodies, followed by insertion of a catchment body into said bore and extending through and communicating with said plugs.

13. A process as in claim 12, wherein, the catchment body is formed with a porous drain pipe placed into said nearly horizontal bore, where the drain pipe is assembled of a plurality of pipe sections joined with sleeve joints.

14. A process as in claim 13, wherein, said drain pipe is covered by a geotextile filter.

15. A process as in claim 12, wherein, a casing is driven into said bore into which a geotextile roll is arranged and then filled with a granular charge, whereupon said casing is removed leaving the filled geotextile roll in place as the catchment body in said bore.

16. A process as in claim 12, wherein, said hole or shaft is lined with a perforated tubular body into which said suction body is placed.

17. A process as in claim 12, wherein, a plurality of granular charge filled geotextile bags are placed on said plug in each hole or shaft.

18. A process as in claim 12, wherein, said hole has a diameter of 30 to 60 cm.

19. A process as in claim 12, wherein, said shaft has a rectangular cross-section with dimensions in the range of 0.4 m to 1.5 m to 0.7 m by 1.6 m.

* * * * *